United States Patent [19]

Freyer

[11] Patent Number: 4,697,312

[45] Date of Patent: Oct. 6, 1987

[54] DEVICE FOR CARRYING AND CLOSING BAGS

[75] Inventor: Hendrik Freyer, Laren, Netherlands

[73] Assignee: Haagexport, B.V., Netherlands

[21] Appl. No.: 916,203

[22] Filed: Oct. 7, 1986

[51] Int. Cl.[4] ..... B65D 77/10

[52] U.S. Cl. ..... 24/30.5 S; 24/30.5 R

[58] Field of Search ..... 24/30.5 S, 30.5 R, 30.5 L, 24/557, 562

[56] References Cited

U.S. PATENT DOCUMENTS

| | | | |
|---|---|---|---|
| 2,029,043 | 1/1936 | Wendell et al. | 24/562 |
| 3,170,213 | 2/1965 | Thomas, Jr. | 24/30.5 S |
| 3,357,070 | 12/1967 | Sloan | 24/30.5 S |
| 4,189,808 | 2/1980 | Brown | 24/30.5 R |
| 4,267,995 | 5/1981 | McMillan | 24/30.5 S |
| 4,279,063 | 7/1981 | Joseph | 24/562 |
| 4,357,740 | 11/1982 | Brown | 24/30.5 S |

FOREIGN PATENT DOCUMENTS

| | | | |
|---|---|---|---|
| 1234618 | 2/1967 | Fed. Rep. of Germany | 24/30.5 S |
| 1255105 | 1/1961 | France | 24/30.5 S |

*Primary Examiner*—Victor N. Sakran

*Attorney, Agent, or Firm*—Pahl, Lorusso & Loud

[57] ABSTRACT

A device for carrying and closing refuse bags comprises a flat carrier ring having a plurality of fingers integrally formed with the carrier ring. The fingers define a conical body member, a wide passage being provided in the center the conical body member for the insertion of the mouth of the bag. The passage is surrounded by the free ends of the fingers and a slot extends intermediate each two adjacent fingers from the passage towards the carrier ring. The slots terminate at a short distance from the carrier ring. Each finger is provided with two prongs separated by a short slot. The carrier rings and fingers are made of a relatively rigid plastic material and the carrier ring is thicker than the fingers.

4 Claims, 4 Drawing Figures

DEVICE FOR CARRYING AND CLOSING BAGS

BACKGROUND OF THE INVENTION

The invention relates to a device for carrying and closing bags, such as refuse bags for example.

U.S. Pat. Nos. 4,189,808 and 4,357,740 each disclose a bag closure device consisting of a conical body member of thin elastic material having a plurality of slots which intersects with one another intermediate of their ends to form resilient prongs. The prongs taper in width toward the point of intersection of said slots to define adjacently disposed pointed ends. The pointed ends of the prongs surround a small opening through which the mouth of the refuse bag can be drawn for closing the refuse bag. As these known bag closure devices are made of a thin elastic material, these devices cannot withstand any substantial force. Therefore, the bag closure device will probably not hold the bag as soon as the refuse bag is lifted up at the bag closure device. Moreover the pointed ends of the prongs will easily cut into the very thin material of the refuse bag so that the bag closure device can easily slip off of the refuse bag if the refuse bag is lifted up at the bag closure device.

SUMMARY OF THE INVENTION

An object of the invention is to provide a bag carrying device of high stength.

A further object of the invention is to provide a bag carrying and closure device by means of which a heavy refuse bag can be carried without any risk of breaking the same.

Another object of the invention is to provide a bag carrying device adapted to close the refuse bag in an effective way and providing the possibility to carry the bag at the device without the risk that the prongs will cut and tear up the refuse bag or that the device will slip off of the refuse bag.

According to the invention there is provided a device for carrying and closing bags, for example refuse bags, comprising a flat carrier ring, a plurality of fingers integrally formed with the carrier ring and defining a conical body member, a wide passage in the centre of the conical body member for the insertion of the mouth of the bag, said passage being surrounded by the free ends of the fingers, a slot extending intermediate each two adjacent fingers from the passage towards the carrier ring, said slots terminating at a distance from the carrier ring, wherein each of said fingers is provided with two prongs separated by a short slot, the carrier ring and fingers being made of a relatively rigid plastic material, and wherein the carrier ring is thicker than the fingers.

The device according to the invention is adapted to easily close a refuse bag or the like in that the mouth of the refuse bag is drawn through the wide passage from the inner side of the conical body member. The fingers keep the bag closed and the closed bag can be lifted up at the device and carried away without the risk of breaking the closure device or tearing up the refuse bag. The prongs of the fingers will grip the refuse bag, wherein the short slot between both prongs of each finger will be filled with material of the refuse bag and thereby prevent a further penetration of the prongs into the refuse bag.

BRIEF DESCRIPTION OF THE DRAWINGS

The invention will be further explained by reference to the drawing in which an embodiment of the device of the invention is shown.

DESCRIPTION OF THE PREFERRED EMBODIMENT

Figure 1:
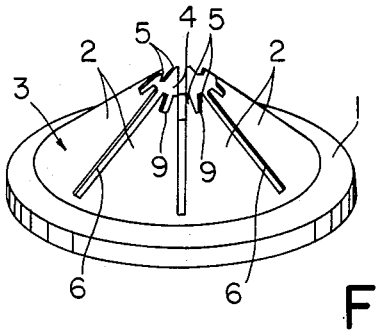
FIG. 1 shows a perspective view of the upper side of an embodiment of the device of the invention.
Figure 2:
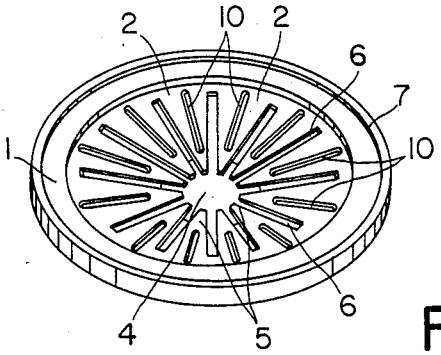
FIG. 2 shows a perspective view of the lower side of the device of FIG. 1.
Figure 3:
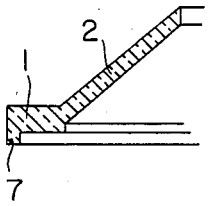
FIG. 3 is a partially shown cross-section of the device of FIG. 1 in a larger scale.

FIGS. 1, 2 and 3 show a device for carrying and closing bags and the like, comprising flat carrier ring 1. The carrier ring 1 supports six fingers 2 regularly distributed along the inner circumference of the carrier ring 1 and all extending obliquely from the carrier ring 1 at an equal angle with the plane of the carrier ring 1, thus defining a conical body member 3. In the centre of the conical body member 3 a wide passage 4 is provided for the insertion of the mouth of the bag. The passage 4 is surrounded by the free ends of the fingers 2. At the embodiment shown each finger 2 comprises at its free end two prongs 5. The device 1 is made in one piece of a relatively rigid plastic material, for example by injection moulding.

Each two adjacent fingers 2 are separated from each other by a slot 6. The slots 6 extend from the passage 4 towards the carrier ring 1 and terminate a short distance from the carrier ring 1. As appears from FIG. 3 the thickness of the carrier ring 1 is greater than the thickness of the fingers 2 so that the fingers 2 are somewhat yieldable whereas the carrier ring 1 together with the first part of the fingers 2 not separated by the slots 6 can withstand very high loads thus giving the device a high strength for carrying heavy refuse bags. To further strengthen the carrier ring 1, there is provided an upstanding ring 7 at the outer circumference of the carrier ring 2 at the side opposite of the fingers 2.

Figure 4:
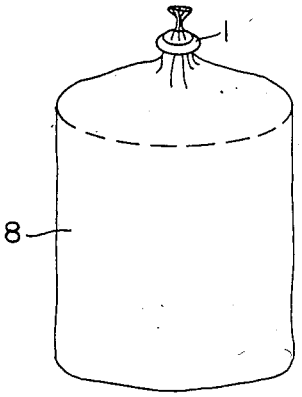
FIG. 4 schematically shows a refuse bag closed by means of the device of FIGS. 1, 2 and 3.

For providing a bag such as for example the refuse bag 8 schematically shown in FIG. 4, with the device, the open upper end of the refuse bag 8 is passed through the passage 4 in the direction of the obliquely extending fingers 2. The fingers 2 thereby close the bag 8, wherein the prongs 5 will grip the material of the refuse bag 8. Therefore, the refuse bag 8 can be closed through a very simple action. Moreover, the refuse bag 8 can be easily lifted up at the location of the carrier ring 1, wherein there exists no risk that the carrier ring 1 slips off of the refuse bag 8. When the prongs 5 cut into the material of the refuse bag 8, some material will enter in short slots 9 between each two two prongs 5 of a finger 2 whereby tearing up the refuse bag 8 will be prevented.

Because the fingers 2 extend obliquely and the prongs 5 engage the material of the refuse bag the fingers 2 when lifting up the bag at the carrier ring 1 will spring back a little, whereby the passage 4 is reduced and the fingers 2 immovably clamp the refuse bag 8.

As shown in FIG. 2 the fingers 2 each include two reinforcing ridges 10 extending in the longitudinal direction, whereby the fingers 2 can stand high loads.

Experiments have shown that the described device can be used to carry refuse bags with a weight of at least 18 kg.

In a favourable embodiment a chemical agent is added to the plastic material of the device, which agent gives out a smell chasing away cats and dogs. Thereby it is effectively prevented that cats and dogs tear up the refuse bag.

The invention is not restricted to the above described embodiments which can be varied in a number of ways within the scope of the invention.

It is for instance possible in case of rather heavy bags, to provide the bags with two or more devices according to the invention which are applied on the bag one above the other. In this way heavier bags may be transported by means of these devices due to their cumulative effect.

I claim:

1. A device for carrying and closing bags, for example refuse bags, comprising a flat carrier ring, a plurality of fingers integrally formed with the carrier ring and defining a conical body member, a wide passage in the center of the conical body member for the insertion of the mouth of the bag, a plurality of slots each extending intermediate each two adjacent fingers from the passage towards the carrier ring, said slots terminating at a distance from the passage towards the carrier ring, wherein each of said fingers is provided with two prongs separated but a short slot, the carrier ring and fingers being made of a relatively rigid plastic material, and wherein the carrier ring is thicker than the fingers.

2. A device according to claim 1, wherein the carrier ring is provided with an upstanding ring at its outer circumference at the side opposite of the fingers.

3. A device according to claim 2, wherein a chemical agent has been added to the plastic material of the device, said agent giving out a smell chasing away cats and dogs.

4. A device according to claim 1 a wherein said wide passage in the center of the conical body member is wide enough to allow said bag to pass therethrough without flexing said relatively rigid fingers.

* * * * *